US006929823B2

(12) United States Patent
Holfter

(10) Patent No.: US 6,929,823 B2
(45) **Date of Patent: *Aug. 16, 2005**

(54) PROCESS FOR THE HIGH-SPEED ROTARY APPLICATION OF LIQUID, PIGMENTED COATING AGENTS

(75) Inventor: Dirk Holfter, Hagen (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/427,421

(22) Filed: May 1, 2003

(65) Prior Publication Data

US 2004/0219300 A1 Nov. 4, 2004

(51) Int. Cl.[7] ..... B05D 3/02

(52) U.S. Cl. ..... 427/190; 427/180; 427/421; 427/427; 427/484

(58) Field of Search ..... 427/484, 421, 427/427, 180, 190

(56) References Cited

U.S. PATENT DOCUMENTS

| | | | | | |
|---|---|---|---|---|---|
| 4,451,597 | A | * | 5/1984 | Victorius | 524/39 |
| 4,785,995 | A | | 11/1988 | Yamane et al. | |
| 5,219,690 | A | * | 6/1993 | Hammond | 430/58.05 |
| 5,225,239 | A | * | 7/1993 | Ostin | 427/8 |
| 5,993,913 | A | | 11/1999 | Rosenberger et al. | |
| 6,029,905 | A | * | 2/2000 | van der Steur | 239/222.11 |
| 6,513,729 | B2 | | 2/2003 | Ochiai et al. | |
| 6,660,325 | B2 | * | 12/2003 | Holfter et al. | 427/121 |
| 6,733,842 | B1 | | 5/2004 | Becker et al. | |
| 2002/0066809 | A1 | * | 6/2002 | Borner et al. | 239/703 |
| 2002/0114891 | A1 | * | 8/2002 | Benayoun et al. | 427/387 |
| 2002/0192357 | A1 | | 12/2002 | Dion | |
| 2003/0197311 | A1 | * | 10/2003 | Stephenson et al. | 264/439 |

FOREIGN PATENT DOCUMENTS

| | | | |
|---|---|---|---|
| DE | 11 77 045 | B | 8/1964 |
| DE | 101 07 951 | A1 | 9/2002 |
| EP | 0 104 395 | A | 4/1984 |
| EP | 0387978 | A2 | 9/1990 |

OTHER PUBLICATIONS

The European Search Report Application No. EP 04009794, Mailed: Dec. 16, 2004.
EPO Search Report mailed Jul. 23, 2004.

* cited by examiner

*Primary Examiner*—Bernard Pianalto
(74) *Attorney, Agent, or Firm*—Steven C. Benjamin

(57) ABSTRACT

A process for the high-speed rotary application of a liquid coating agent containing at least one pigment and/or at least one extender onto a substrate, wherein the process comprises the steps:

(a) directly supplying at least two liquid components in a specified quantity ratio which determines the qualitative and quantitative composition of the coating agent to at least one high-speed rotary atomizer or preparation of a premix from at least two liquid components in a specified quantity ratio which determines the qualitative and quantitative composition of the coating agent and supply of the premix to at least one high-speed rotary atomizer, (b) high-speed rotary atomizing the components directly supplied in step (a) or of the premix supplied in step (a) to the at least one high-speed rotary atomizer and (c) applying the material atomized in step (b) onto a substrate, wherein at least one of the components used in step (a) contains at least one pigment and/or at least one extender.

12 Claims, No Drawings

PROCESS FOR THE HIGH-SPEED ROTARY APPLICATION OF LIQUID, PIGMENTED COATING AGENTS

FIELD OF THE INVENTION

The present invention relates to a process for the high-speed rotary application of liquid, pigmented coating agents (containing one or more pigments and/or extenders), wherein the coating agents are formed from at least two liquid components during the course of high-speed rotary application.

BACKGROUND OF THE INVENTION

Liquid, pigmented coating agents are conventionally produced using a base formulation, in which the pigment(s) is (are) ground in the binder or in a special paste resin. The finished coating agent is formulated by mixing the base formulation with a proportion of an additional binder component and optionally, any other additional constituents may be added.

Another conventional alternative for the production of liquid, pigmented coating agents is to use a paint mixing system in which liquid coating agents having different colors are mixed together to yield the liquid coating agent with the desired pigmentation or desired color shade. The different color liquid coating agents are per se finished compositions, i.e., ready to apply compositions.

A further alternative is production by mixing components, wherein at least one of the components to be mixed is not per se a finished (ready to apply) coating agent. For example, the coating agent, which is pigmented as desired, may be produced by mixing pigmented and optionally, unpigmented semi-finished products or by mixing a per se finished coating base with one or more pigment pastes (tinting pastes).

In industrial mass-production coating with pigmented liquid coatings, for example, in automotive original coating, many coating layers are applied in more than one color shade, i.e. with different pigmentation. For example, in automotive original coating, in particular, the primer surfacer or base coat layer are applied in a number of different color shades corresponding to the color shade range, wherein the various pigmented primer surfacer or base coat coating agents are each applied from a separate circulating line. The number of circulating lines for coating agents in standard color tones is here limited for logistical reasons. Applying coatings of special color tones in addition to the coatings in standard color tones can only be achieved with considerable additional effort.

DE 101 07 951 A1 describes a process for coating a substrate in a specified mixed color tone, wherein the coating is produced in the desired mixed color tone by means of a mixing apparatus in the flow path upstream from an application unit and is then applied onto the substrate.

The process according to DE 101 07 951 A1 overcomes the above-stated logistical problem and also makes it possible to achieve integration of coating agent production virtually into the coating application process. However, in many cases, the degree of mixing of the applied coating agent is in need of improvement. Moreover, the process can only be used with components that are readily miscible with one another.

The process according to the invention described below not only provides an alternative solution to the process of DE 101 07 951 A1, but also provides an improvement in the resulting coating since the applied coating agent has an extraordinarily good homogeneity. The process according to the invention is also usable in those cases in which the coating agent is formed from components which, by their nature, can be mixed together only with difficulty and with particular effort. For example, components may be difficult to mix together if the components to be mixed have relatively different properties, for example, different density, viscosity and/or polarity/nonpolarity. The quality of a coating applied from a coating agent produced by mixing two or more components with regard to technical and/or optical properties is dependent upon the degree of mixing of the components before application. It is generally known that greater homogeneity of such a mixture, for example, finer dispersion, is accompanied by an increase in the quality of the coating applied therefrom.

SUMMARY OF THE INVENTION

A first embodiment of the invention relates to a process for the high-speed rotary application of a liquid coating agent containing at least one pigment and/or at least one extender onto a substrate, wherein the process comprises the steps:

(a) directly supplying at least two, preferably only two, liquid components in a specified quantity ratio which determines the qualitative and quantitative composition of the coating agent to at least one high-speed rotary atomizer, (b) high-speed rotary atomizing the components directly supplied in step (a) to the at least one high-speed rotary atomizer and (c) applying the material atomized in step (b) onto a substrate, wherein at least one of the components used in step (a) contains at least one pigment and/or at least one extender.

The second embodiment of the invention relates to a process for the high-speed rotary application of a liquid coating agent containing at least one pigment and/or at least one extender onto a substrate, wherein the process comprises the steps:

(a) preparing a premix from at least two, preferably only two, liquid components in a specified quantity ratio which determines the qualitative and quantitative composition of the coating agent, (b) supplying the premix from step (a) to at least one high-speed rotary atomizer, (c) high-speed rotary atomizing the premix supplied in step (b) to the at least one high-speed rotary atomizer and (d) applying the material atomized in step (c) onto a substrate, wherein at least one of the components used in step (a) contains at least one pigment and/or at least one extender.

DETAILED DESCRIPTION OF THE EMBODIMENTS

In the first embodiment, the coating agent is formed and applied from at least two liquid components virtually in a single operation. The at least two liquid components are directly supplied to the at least one high-speed rotary atomizer, for example, via a T-piece which is arranged immediately upstream from the feed orifice of the high-speed rotary atomizer(s) or is a component of the high-speed rotary atomizer(s). During coating of a substrate, the at least two liquid components are supplied to the at least one high-speed rotary atomizer in a specified quantity ratio which determines the qualitative and quantitative composition of the liquid, pigmented coating agent, for example, using suitable metering devices, such as, for example, gear pumps.

In the second embodiment of the process according to the invention, the at least two liquid components are not directly supplied to the at least one high-speed rotary atomizer. Instead, the process comprises the additional, preceding step of producing a premix from components, as are directly supplied to the at least one high-speed rotary atomizer in step (a) of the first embodiment. Before application, the coating agent is initially prepared by mixing at least two liquid components in a specified quantity ratio which determines the qualitative and quantitative composition of the coating agent to form a premix, after which it is supplied to the at least one high-speed rotary atomizer and only then is it atomized and applied. Relative to the degree of mixing in the premix, the degree of mixing is increased on atomization and/or application. Premixing may proceed either continuously or discontinuously, but continuous premixing is preferred for the purposes of industrial mass-production coating. Continuous premixing may here be achieved in conventional manner, for example, by means of a multicomponent mixing unit, in particular a two-component mixing unit, for example, a conventional static mixer, such as, a Kenics mixer, as is conventionally used in automotive original coating. During coating of a substrate, the at least two liquid components are supplied to the multicomponent mixing unit in a specified quantity ratio which determines the qualitative and quantitative composition of the liquid, pigmented coating agent, for example, using suitable metering devices, such as, for example, gear pumps.

The term "premix" used in connection with the second embodiment refers to the mixture of the at least two liquid components of the liquid, pigmented coating agent with a greater or lesser degree of mixing or homogenization which varies as a function of the nature of the premixed components. The term "premix" is intended to relate to the mixture which is fed into the high-speed rotary atomizer(s) and does not mean the mixture after having entered the bell dish of the rotary atomizer(s).

In both embodiments of the process according to the invention, at least two, preferably no more than four, but preferably only two, liquid components are used in step (a) in a specified quantity ratio which determines the qualitative and quantitative composition and also the pigmentation or color shade of the coating agent. With regard to the quantity ratio, it is generally the case that the proportion by volume of the component with the largest proportion by volume is at most one hundred times, preferably at most ten times, as large as the proportion by volume of the component with the smallest proportion by volume.

The coating agent, i.e. the atomized material obtained in step (b) of the first embodiment or in step (c) of the second embodiment, is applied onto the substrate by high-speed rotary application, preferably by electrostatically-assisted high-speed rotary application. In the case of electrostatic support, the coating agent may be charged directly by means of the high-speed rotary bell or externally charged. The coating agent may be applied in one or more spray passes to any substrate such as, for example, automobile bodies or body parts. The high-speed rotary atomizer(s) may be passed by means of an automatically controlled machine or a coating robot over the substrate surfaces to be coated.

Examples of high-speed rotary atomizers include conventional rotary bells suitable for the application of liquid coatings and are made of metal, for example, aluminum, titanium or refined steel, wherein the circular spray edges of the atomizers have a diameter of, for example, 5 cm to 12 cm. Examples of such rotary bells include the ECO-M bell (manufactured by DÜRR GmbH, Bietigheim Bissingen, Germany) or the G1 atomizer (manufactured by ABB Flexible Automation, Friedberg, Germany). The spray edges of the rotary bells may be unserrated, but are preferably serrated, and more preferably straight-, cross- or diagonally-serrated.

The circumferential velocity of the spray edge lies in the range of 3,000 to 25,000 m/min, preferably 10,000 to 25,000 m/min.

For the preferred range of the circumferential velocity of the spray edge of 10,000 to 25,000 m/min, this means that, if the spray edge has, for example, a diameter of 6.5 cm, the rotational speed (measured as revolutions per minute) will be in the range from, for example, 50,000 to 120,000 $m^{-1}$, or if the spray edge has, for example, a diameter of 5 cm, the rotational speed will be in the range from, for example, 65,000 to 156,000 $min^{-1}$. In each case, the preferred range of 10,000 to 25,000 m/min for the circumferential velocity of the spray edge is 10% to 150% higher than is used in the art for the rotary atomizing application of liquid coating agents.

In the present invention, the outflow rate of the coating agent lies in the conventional range of 50 to 1,000 ml/min of coating agent per high-speed rotary atomizer.

Furthermore, it may be advantageous to operate the shaping air normally used in high-speed rotary atomization with large amounts of air of, for example, 100 to 600 l/min per high-speed rotary atomizer.

Without wishing to be bound by theory, it is assumed that the liquid components supplied directly to the high-speed rotary atomizer(s) in step (a) of the first embodiment or the premix supplied in step (b) of the second embodiment undergo highly effective homogenization, for example, in the form of fine dispersion of components or constituents of components of the coating agent, on the bell dish and/or on the spray edge during the actual atomization process and/or during the path to the substrate surface to be coated and/or when contacting the substrate surface.

The liquid, pigmented coating agents to be applied using the process according to the invention may comprise non-aqueous or aqueous coating agents. Accordingly, the at least two liquid components used in step (a) of both embodiments of the process according to the invention may be comprised of one of a variety of combinations of liquid and conveyable, in particular pumpable, components including: (1) at least two non-aqueous components and without aqueous components, (2) at least one aqueous component and at least one non-aqueous component, (3) at least two aqueous components and without non-aqueous components, or (4) at least two non-aqueous components, water and without aqueous components. During the preparation of an aqueous coating agent in cases (2) and (3), water may be added if desired, for example, in order to obtain a particular solids content or a particular viscosity. In cases (2) and (3), the added water should not be regarded as one of the components of the aqueous coating agent. In all three cases (2), (3) and (4), the added water should not be confused with an aqueous component.

In the case of both non-aqueous and aqueous coating agents, the at least two liquid components used in step (a) of both embodiments of the process according to the invention may each comprise per se ready-to-apply coating agents which differ from one another with regard to the pigmentation thereof. They may, for example, comprise various pigmented mixing paints, for example, mixing paints of a different color shade, from a paint mixing system which, depending upon the nature of the pigmentation thereof and the desired pigmentation of the liquid, pigmented coating agent to be applied, are used in a quantity ratio which determines the qualitative and quantitative composition of the liquid, pigmented coating agent. One or more, per se ready-to-apply, unpigmented clear coat paints may also be present as constituents of, the paint mixing system and accordingly be used in combination with one or more pigmented mixing paints.

In the preferred case of only two liquid components, two different pigmented, liquid coating agents may be used in step (a) of both embodiments of the process according to the invention. For example, when preparing primer surfacer coating layers, which many automotive manufacturers apply in non-chromatic color shades, it is possible in this manner to provide primer surfacer coatings of a very wide range of shades of grey for specific car bodies from a white primer surfacer coating agent and a black primer surfacer coating agent. This is, for example, of particular interest when it is desired to adapt the color of the primer surfacer to the color shade of the base coat or top coat which is to be applied as the following coating layer.

Alternatively, it is equally possible for the at least two liquid components used in step (a) of both embodiments of the process according to the invention to comprise components, at least one of which is not a per se ready-to-apply coating agent. The liquid, pigmented coating agent may, for example, be formed by combining pigmented and optionally, unpigmented semi-finished products or by combining a per se ready-to-apply coating agent in the form of a pigmented, for example, white pigmented coating base or unpigmented coating base (clear coat), with at least one pigment paste (tinting paste). The at least one pigment paste may here, for example, be member of a series of pastes comprising variously pigmented pigment pastes.

The liquid, pigmented coating agents contain water and/or organic solvent. Examples of organic solvents that may be used in the coating agents include glycol ethers, such as, butyl glycol, butyl diglycol, dipropylene glycol dimethyl ether, dipropylene glycol monomethyl ether, and ethylene glycol dimethylether, glycol ether esters, such as, ethyl glycol acetate, butyl glycol acetate, butyl diglycol acetate, and methoxypropyl acetate; esters, such as, butyl acetate, isobutyl acetate, and amyl acetate; ketones, such as, methyl ethyl ketone, methyl isobutyl ketone, diisobutyl ketone, cyclohexanone, and isophorone; alcohols, such as, methanol, ethanol, propanol, and butanol; aromatic hydrocarbons, such as, xylene, Solvesso 100 (mixture of aromatic hydrocarbons with a boiling range from 155° C. to 185° C.), Solvesso 150 (mixture of aromatic hydrocarbons with a boiling range from 182° C. to 202° C.) and aliphatic hydrocarbons.

The liquid, pigmented coating agents contain at least one binder and optionally, at least one paste resin. Non-aqueous coating agents contain binders dissolved and/or dispersed in organic solvents. Aqueous coating agents contain binders dissolved in water and/or in aqueously dispersed (emulsified and/or suspended) form. The binders may be physically drying, oxidatively drying or chemically self- or externally crosslinking. In the case of externally crosslinking binders, the coating agent may also contain crosslinking agents for the binders. Corresponding binders or binder/crosslinking agent systems are known to the person skilled in the art and require no explanation.

The liquid, pigmented coating agents contain at least one conventional color- and/or special effect-imparting, organic or inorganic pigment and/or at least one extender. Examples are carbon black, titanium dioxide, iron oxide pigments, azo pigments, perylene pigments, phthalocyanine pigments, aluminium pigments, mica pigments, talcum and kaolin.

In addition to pigment(s) and/or extender(s), binder(s), crosslinking agent(s) and organic solvent(s) and/or water, the liquid, pigmented coating agents may optionally also contain reactive diluents and/or conventional coating additives, such as, for example, neutralizing agents, levelling agents, dyes, light stabilizers, antioxidants, rheology control agents, antisettling agents, antifoaming agents, adhesion promoting substances and catalysts.

The application process according to the invention may be used in the field of industrial coating with pigmented, liquid coatings, in particular, in the production of pigment-containing coatings in automotive body and automotive body part original coating, for example, in the production of primer surfacer, color- and/or special effect-imparting base coat or top coat layers. The process may here assist in minimizing logistical effort with regard to stock-holding and supply of differently pigmented liquid coating agents and application of the process is not restricted to the use of components which are readily miscible with one another. The coating layers prepared by the process according to the invention are of elevated quality.

The following examples illustrate the invention.

EXAMPLES

Examples 1 to 4 (application of aqueous primer surfacers)

Example 1

A conventional commercial white aqueous primer surfacer (Herberts Aqua Fill, R 63256.2 from DuPont Performance Coatings GmbH & Co. KG, Wuppertal) and a conventional commercial black aqueous primer surfacer (Herberts Aqua Fill, R 63473.5 from DuPont Performance Coatings GmbH & Co. KG, Wuppertal) were each conveyed using a metering gear pump in a 1:1 ratio by volume into a T piece, from which the product streams combined in this manner were immediately supplied to the feed orifice of a high-speed rotary atomizer (atomizer ECO-M-bell from D ÜRR). Application was performed by means of high-speed rotary application to a dry film thickness of 35 $\mu$m onto a conventional, cathodically electrodeposition coated metal test panel. During application, the 6.5 cm diameter spray edge had a rotational speed of 45,000 $min^{1}$, corresponding to a circumferential velocity of 9,185 m/min. After flashing off for 10 minutes at 20° C., the metal test panel coated with aqueous primer surfacer was baked for 20 minutes at an object temperature of 160° C.

Example 2

Example 1 was repeated with the sole difference that a rotational speed of 70,000 $min^{-1}$, corresponding to a circumferential velocity of the spray edge of 14,287 m/min, was used.

Both in Example 1 and in Example 2, a grey primer surfacer coat was obtained which in each case provided a uniform color appearance to the observer.

Example 3

3.1 A mixture of 4.69 pbw (parts by weight) of Bayhydrol® D 270 (polyester, Bayer Leverkusen)

7.72 pbw of water 0.65 pbw of a 10 wt. % aqueous solution of dimethylethanolamine 0.59 pbw of Surfynol 104 (50% in N-methylpyrrolidone, wetting additive from Air Products)

0.59 pbw of Additol® XW 395 (levelling additive from Solutia)

11.54 pbw of titanium dioxide 1.15 pbw of black iron oxide 11.60 pbw of barium sulfate 0.40 pbw of Aerosil® R 972 (silica, from Degussa)

0.98 pbw of talcum was ground in conventional manner in a bead mill.

3.2 A mixture of 28.05 pbw of Bayhydrol® VP LS 2341 (polyurethane dispersion, Bayer Leverkusen)

24.38 pbw of Bayhydrol® XP 2438 (polyester urethane dispersion, Bayer Leverkusen)

7.55 pbw of Maprenal® VMF 3921 W (melamine resin from Solutia)

3.00 pbw of water 0.11 pbw of dimethylethanolamine was prepared.

The mixtures obtained in 3.1 and 3.2 were each conveyed using a metering gear pump in a ratio by volume of mixtures 3.1:3.2 into a T piece, from which the product streams combined in this manner were immediately supplied to the feed orifice of a high-speed rotary atomizer (atomizer: ECO-M-bell from DÜRR). Application was performed by means of high-speed rotary application to a dry film thickness of 35 $\mu$m onto a conventional, cathodically electrodeposition coated metal test panel. During application, the 6.5 cm diameter spray edge had a rotational speed of 45,000 $min^{-1}$, corresponding to a circumferential velocity of 9,185 m/min. After flashing off for 10 minutes at 20° C., the metal test panel coated with aqueous primer surfacer was baked for 20 minutes at an object temperature of 160° C.

Example 4

Example 3 was repeated with the sole difference that a rotational speed of 70,000 $min^{-1}$, corresponding to a circumferential velocity of the spray edge of 14,287 m/min, was used.

Both in Example 3 and in Example 4, a primer surfacer coat was obtained which in each case provided a uniform color appearance to the observer. However, the observed gloss appearance was greater in Example 4.

What is claimed is:

1. A process for the high-speed rotary application of a liquid coating agent containing at least one pigment and/or at least one extender onto a substrate, wherein the process comprises the steps:

(a) directly supplying at least two liquid components in a specified quantity ratio which determines the qualitative and quantitative composition of the coating agent to at least one high-speed rotary atomizer having a spray edge and said spray edge having a circumferential velocity in the range of 10,000 to 25,000 m/min, (b) high-speed rotary atomizing the components directly supplied in step (a) to the at least one high-speed rotary atomizer and (c) applying the material atomized in step (b) onto a substrate, wherein at least one of the components used in step (a) contains at least one pigment, or at least one extender or a mixture of pigment and extender;

further wherein the at least two components of step (a) are homogenized as said components are atomized in step (b) and applied to the substrate in step (c);

further wherein said substrate is an automotive body or part thereof.

2. A process for the highi-speed rotary application of a liquid automotive coating agent containing at least one pigment and/or at least one extender onto a substrate, wherein the process comprises the steps:

(a) continuously preparing a premix from at least two liquid components in a specified quantity ratio which determines the qualitative and quantitative composition of the coating agent, (b) supplying the premix from step (a) to at least one high-speed rotary atomizer having a spray edge and said spray edge having a circumferential velocity in the range of 10,000 to 25,000 m/min, wherein said premix is prepared immediately prior to being supplied to the high-speed atomizer, (c) high-speed rotary atomizing the premix supplied in step (b) to the at least one high-speed rotary atomizer and (d) applying the material atomized in step (c) onto a substrate, wherein at least one of the components used in step (a) contains at least one pigment, or at least one extender or a mixture of pigment and extender;

further wherein the premix of step (a) is homogenized as said pre-mix is atomized in step (c) and applied to the substrate in step (d);

further wherein said substrated is an automotive body or part thereof.

3. The process of claim 1, wherein only two liquid components are used in step (a).

4. The process of claim 1, wherein the at least two liquid components used in step (a) each comprise per se ready-to-apply coating agents which differ from one another with regard to the pigmentation thereof.

5. The process of claim 1, wherein the circumferential velocity of the spray edge of the at least one high-speed rotary atomizer is in the range from 3,000 to 25,000 m/min.

6. The process of claim 1, wherein the liquid, pigmented coating agent comprises a coating agent selected from the group consisting of non-aqueous and aqueous coating agents.

7. A process for the high-speed rotary application of a liquid coating agent containing at least one pigment and/or at least one extender onto a substrate, wherein the process comprises the steps:

(a) continuously preparing a premix from at least two liquid components in a specified quantity ratio which determines the qualitative and quantitative composition of the coating agent, (b) supplying the premix from step (a) to at least one high-speed rotary atomizer, wherein said premix is prepared immediately prior to being supplied to the high-speed atomizer, (c) high-speed rotary atomizing the premix supplied in step (b) to the at least one high-speed rotary atomizer and (d) applying the material atomized in step (c) onto a substrate, wherein at least one of the components used in step (a) contains at least one pigment, or at least one extender or a mixture of pigment and extender;

further wherein the premix of step (a) is homogenized as said pre-mix is atomized in step (c) and applied to the substrate in step (d).

8. The process of claim 7, wherein the liquid, pigmented coating agent comprises a coating agent selected from the group consisting of non-aqueous and aqueous coating agents.

9. The process of claim 7, wherein only two liquid components are used in step (a).

10. The process of claim 7, wherein the at least two liquid components used in step (a) each comprise per se ready-to-apply coating agents which differ from one another with regard to the pigmentation thereof.

11. The process of claim 7, wherein the circumferential velocity of the spray edge of the at least one high-speed rotary atomizer is in the range from 3,000 to 25,000 m/min.

12. The process of claim 7, wherein the at least two liquid components used in step (a) comprise components, at least one of which is not a per se ready-to-apply coating agent.

* * * * *

UNITED STATES PATENT AND TRADEMARK OFFICE

CERTIFICATE OF CORRECTION

PATENT NO. : 6,929,823 B2
DATED : August 16, 2005
INVENTOR(S) : Holfter

It is certified that error appears in the above-identified patent and that said Letters Patent is hereby corrected as shown below:

Column 7,
Line 54, insert -- automotive -- after "liquid" and before "coating".

Column 8,
Line 35, delete "substrated" replace with -- substate. --.
Line 39, delete claim 4 in its entirety and insert -- The process of claim 2, wherein only two liquid components are used in step (a). --.
Line 43, delete claim 5 in its entirety and insert -- The process of claim 1, wherein the liquid, pigmented coating agent comprises a coating agent selected from the group consisting of non-aqueous and aqueous coating agents.
Line 47, delete claim 6 in its entirety and insert -- The process of claim 2, wherein the liquid, pigmented coating agent comprises a coating agent selected from the group consisting of non-aqueous and aqueous coating agents. --.
Line 51, delete claim 7 in its entirety and insert -- The process of claim 1, wherein the at least two liquid components used in step (a) each comprise per se ready-to-apply coating agents which differ from one another with respect to the pigmentation thereof. --.

Column 9,
Line 7, delete claim 8 in its entirety and insert -- The process of claim 2, wherein the at least two liquid components used in step (a) each comprise per se ready-to-apply coating agents which differ from one another with regard to the pigmentation thereof. --.
Line 11, delete claim 9 in its entirety and insert -- The process of claim 1, wherein the at least two liquid components used in step (a) comprise components, at least one of which is not a per se ready-to-apply coating agent.--.

UNITED STATES PATENT AND TRADEMARK OFFICE

CERTIFICATE OF CORRECTION

PATENT NO. : 6,929,823 B2
DATED : August 16, 2005
INVENTOR(S) : Holfter

It is certified that error appears in the above-identified patent and that said Letters Patent is hereby corrected as shown below:

Column 10,
Line 1, delete claim 10 in its entirety and insert -- The process of claim 2, wherein the least two liquid components used in step (a) comprise components, at least one of which is not per se ready-to-apply coating agent. --.
Line 5, delete claim 11 in its entirety.
Line 8, delete claim 12 in its entirety.

Signed and Sealed this

Sixteenth Day of May, 2006

JON W. DUDAS
*Director of the United States Patent and Trademark Office*